United States Patent [19]

Nishioka et al.

[11] 3,935,555

[45] Jan. 27, 1976

[54] ASSEMBLY FOR FINE ADJUSTMENT OF A VARIABLE IMPEDANCE MECHANISM

[75] Inventors: Matsuo Nishioka; Shunzo Oka, both of Hirakata, Japan

[73] Assignee: Matsushita Electric Industrial Co., Ltd., Kadoma, Japan

[22] Filed: Oct. 10, 1974

[21] Appl. No.: 513,727

[30] Foreign Application Priority Data

| | | |
|---|---|---|
| Oct. 19, 1973 | Japan | 48-121331[U] |
| Oct. 19, 1973 | Japan | 48-121332[U] |
| Oct. 19, 1973 | Japan | 48-121333[U] |
| Oct. 19, 1973 | Japan | 48-121334[U] |
| Oct. 19, 1973 | Japan | 48-121335[U] |
| Oct. 19, 1973 | Japan | 48-121336[U] |

[52] U.S. Cl. ..... 338/174; 338/130; 338/180

[51] Int. Cl.[2] ..... H01C 5/02

[58] Field of Search ..... 338/130, 148, 162, 174, 338/175, 180, 184

[56] References Cited

UNITED STATES PATENTS

| | | | |
|---|---|---|---|
| 3,150,343 | 9/1964 | Lippman | 338/174 |
| 3,201,737 | 8/1965 | Mathison | 338/174 |
| 3,416,119 | 12/1968 | Van Benthuysen et al. | 338/174 |
| 3,582,857 | 6/1971 | Kishel | 338/174 |
| 3,701,070 | 10/1972 | Baldwin et al. | 338/162 |
| R25,725 | 2/1965 | Ferrell et al. | 338/174 |

*Primary Examiner*—Volodymyr Y. Mayewsky
*Attorney, Agent, or Firm*—Burgess Ryan and Wayne

[57] ABSTRACT

An assembly for fine adjustment of a variable impedance mechanism is disclosed wherein a first disk-shaped rotary member, which functions as a knob, has a spiral ridge or groove formed on one side surface thereof for engagement with the teeth of a second disk-shaped rotary member or teethed wheel whose shaft is in turn coupled to the rotary shaft of a variable impedance element. When the first rotary member makes one rotation, the second rotary member is advanced one tooth, whereupon the fine adjustment of the variable impedance element is possible.

11 Claims, 10 Drawing Figures

ASSEMBLY FOR FINE ADJUSTMENT OF A VARIABLE IMPEDANCE MECHANISM

BACKGROUND OF THE INVENTION

The present invention relates generally to a variable impedance device with an assembly for fine adjustment of a variable impedance mechanism and more particularly to a device capable of extreme fine adjustment of the rotation of the rotary shaft of a rotary type variable resistor or capacitor.

In general, the component parts of a variable impedance element are subjected to deformations, expansions and contractions due to changes in environmental conditions, so that the characteristics of the variable impedance element becomes unstable. It is particularly true in the case where the variable impedance element consists of a large number of parts. Therefore, when a fine adjustment mechanism is incorporated in a variable impedance element, the characteristics of the latter are more adversely affected. It is difficult to assemble stopper means for limiting the angle of rotation means for indicating the angle of rotation and so on within the variable impedance element. Moreover, the characteristics of the variable impedance element incorporating the fine adjustment mechanism change due to the environmental changes. Furthermore, various limitations are imposed upon the design for incorporating the fine adjustment mechanism within the variable impedance element.

SUMMARY OF THE INVENTION

One of the objects of the present invention is therefore to provide a fine adjustment mechanism for a variable impedance device which is very simple in construction and may provide a considerably greater speed reduction ratio.

Another object of the present invention is to provide a fine adjustment mechanism disposed outside of a variable impedance element so that the variation in characteristics of the latter due to the changes in environmental conditions may be minimized.

A further object of the present invention is to provide a fine adjustment mechanism for a variable impedance device which is very simple in construction and consists of a fewer number of parts.

To attain the above and other objects of the present invention, a spiral ridge is formed upon one side surface of a first disk-shaped rotary member, which functions as a knob, and engages the teeth of a second disk-shaped rotary member or toothed wheel. The first and second rotary members rotate in planes perpendicular to each other, and one rotation of the first rotary member causes the second rotary member to advance one tooth. The second rotary member is coupled to the rotary shaft of the variable impedance element. Therefore, one rotation of the first rotary member causes the rotary shaft of the variable impedance member to rotate through an extremely small angle corresponding to one tooth advancement of the second rotary member, so that the extremely fine adjustment of the variable impedance element may be accomplished.

According to one embodiment of the present invention, a stopper is extended from the rotary shaft of the second rotary member at a right angle to the axis thereof for engagement with an engaging member on the variable impedance device so that the angle of rotation of the second rotary member and hence the rotary shaft of the variable impedance member may be limited.

According to another embodiment of the present invention, an arcuate ridge or strip is formed on one side surface of the second rotary member coaxially thereof, the width of the arcuate ridge or strip changing linearly from one end to the other end. Therefore, the width of the arcuate ridge or strip viewed through a window changes as the second rotary member rotates so that the angle of rotation of the rotary shaft of the variable impedance member may be easily detected.

According to a further embodiment of the present invention, one end of the shaft of the second rotary member terminates into a flat bifurcated retaining member which is snugly fitted into the mating hole formed through the rotary shaft of the variable impedance element. The extreme ends of the bifurcated retaining member extended beyond the variable impedance element is rotatably fitted into the hole formed through a supporting member or into the coaxial hole formed at one end of the shaft of the second rotary member in another fine adjustment mechanism juxtaposed thereto.

The above and other objects, features and advantages of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

First Embodiment, FIGS. 1 through 4B

Figure 1:
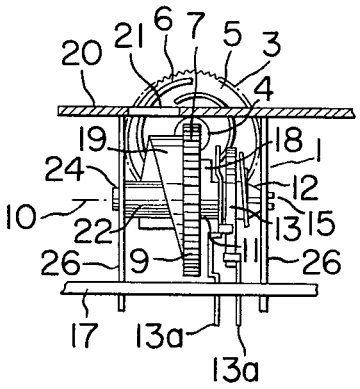
FIG. 1 is a front view of a first embodiment of a variable impedance device with a fine adjustment mechanism in accordance with the present invention.
Figure 2:
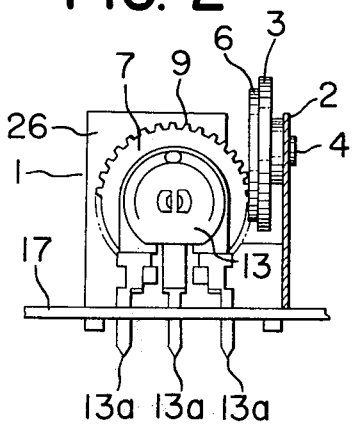
FIG. 2 is a side view of the embodiment of FIG. 1.
Figure 3:
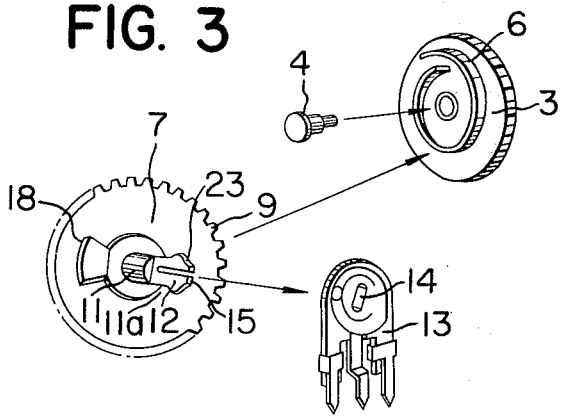
FIG. 3 is an exploded view of the embodiment of FIG. 1.
Figure 4A:
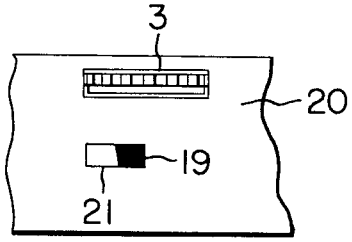
FIG. 4A and 4B are a top view, on enlarged scale, of the embodiment of FIG. 1 illustrating means for indicating the angle of rotation of the rotary shaft of an impedance element.
Figure 4B:
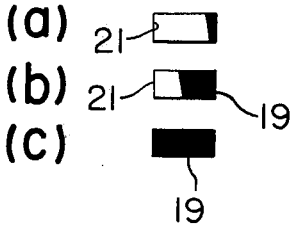

A first disk-shaped rotary member or knob 3 is rotatably carried by a rivet 4 attached to a side wall 2 of a casing generally indicated by the reference numeral 1. The upper part of the first rotary member 3 is partly extended through an elongated slot formed through a top plate 20 so that one may rotate the first rotary member with his finger. A spiral ridge 6 is attached to one side surface 5 of the first rotary member 3 and engaging the teeth 9 of a second disk-shaped rotary member or toothed wheel 7 carried by a shaft 22 which is rotatably supported between the opposing side walls 26 for rotation about the axis 10 which is at a right angle with respect to the axis of rotation of the first rotary member 3. The spiral ridge 6 is so formed that when the first rotary member 3 makes one rotation, the second rotary member or toothed wheel 7 is advanced one tooth. The right end of the right section 11 of the shaft 22 terminates into a flat bifurcated retainer member 11*a* with projections 12 which is fitted or snapped into an elongated through hole in a rotary shaft of a variable resistor 13 so that the second rotary member 7 and the shaft of the variable resistor 13 may rotate in unison. The extreme end of the bifurcated retainer member extends beyond the hole of the rotary shaft of the variable resistor 13 and is rotatably fitted into a hole 16 formed through one or right side wall 26. Since the extreme end 15 is tapered to converge outwardly as shown at 23 in FIG. 3, it is securely retained in the hole 16; that is, there is no danger that the extreme end 15 may be pulled out of the hole 16. Terminals 13*a* of the variable resistor 13 are soldered to a printed circuit board 17. A stop 18 is fitted over the right hand section 11 of the shaft 22 for engagement with a mating engaging member (not shown) on the variable resistor 13 so that the angle of rotation of the shaft 22 and hence the rotary shaft of the variable resistor 13 may be limited. The left end of the shaft 22 terminates into a reduced diameter portion 24 which is rotatably fitted into a hole 25 formed through the other side wall 26 so that the shaft 22 may be firmly retained in position between the opposing side walls 26. Upon the left side surface of the second rotary member or toothed wheel 7 is attached a ridge or strip whose width (that is, the height from the side surface of the second rotary member 7) linearly increases from one end to the other end and which is coaxial with the axis 10 of rotation. A window 21 is formed through the top plate 20 in parallel and in opposed relation with the shaft 22, so that one may observe the width of the arcuate ridge or strip member 19 which changes as the second rotary member 7 rotates. Thus, the angle of rotation of the second rotary member 7 and hence the change in resistance of the variable resistor 13 may be indicated as best shown in FIG. 4A. For instance, FIG. 4B(*a*) shows that the angle of rotation of the second rotary member 7 is zero: (*b*) shows that the rotary member 7 has reached the midpoint of its range of rotation; and (*c*) shows that the second rotary member 7 has rotated through the maximum allowable angle.

It is to be understood that instead of the spiral ridge 6 attached to the first rotary member 3, spiral groove may be formed in one side surface of the first rotary member 3.

Figure 5:
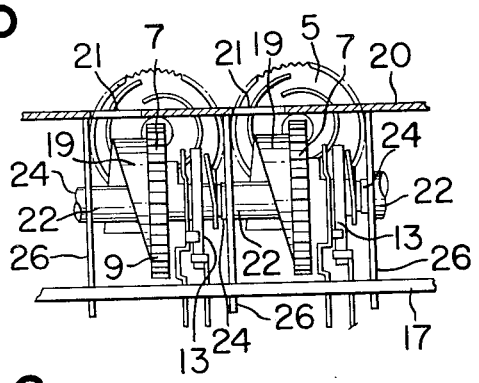
FIG. 5 is a front view of a second embodiment of the present invention in which two variable impedance devices with a fine adjustment mechanism are juxtaposed.
Figure 6:
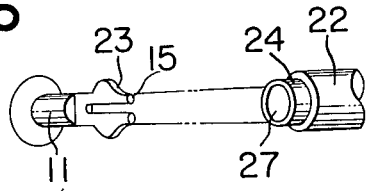
FIG. 6 is an exploded view illustrating the coupling between the shafts of the second rotary members of the embodiment shown in FIG. 4.
Figure 7:
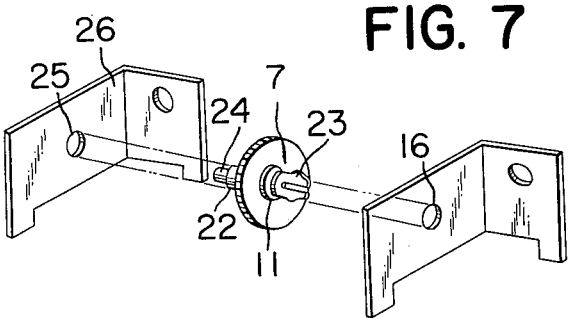
FIG. 7 is an exploded view illustrating the arrangement for supporting the shaft of the second rotary member in the second embodiment.

Second Embodiment, FIGS. 5, 6, and 7

In the second embodiment of the present invention shown in FIGS. 5, 6, and 7, two fine adjustment mechanisms of the type described above with reference to FIGS. 1 through 4B are juxtaposed. In order to align the shafts 22 of the second rotary members 7, the extreme ends 15 of the shaft 22 of the left mechanism is rotatably fitted into a hole 27 formed coaxially at the reduced diameter portion 24 of the shaft 22 of the right mechanism as shown in FIGS. 6 and 7. That is, the reduced diameter portion 24 is rotatably fitted into the hole 25 of the side wall 26 and the extreme ends 15 of the shaft 22 of the left mechanism is rotatably fitted into the hole 27 at the reduced diameter portion 24. In like manner, any desired number of the fine adjustment mechanisms of the present invention may be disposed in side-by-side relation.

Figure 8:
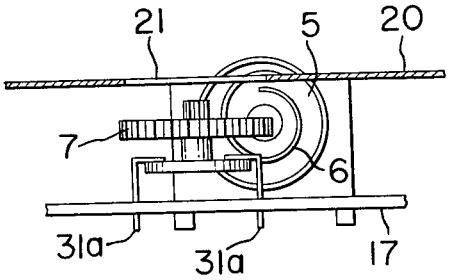
FIG. 8 is a front view of a third embodiment of the present invention.
Figure 9:
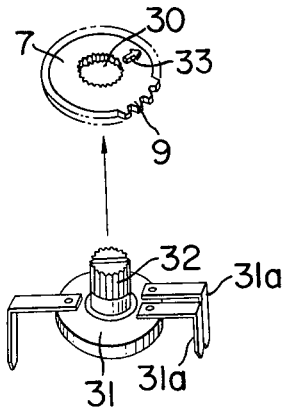
FIG. 9 is an exploded view of the third embodiment illustrating the coupling between the second rotary member and the rotary shaft of the variable impedance element in the third embodiment.

Third Embodiment, FIGS. 8 and 9

The third embodiment of the present invention to be described hereinafter with reference to FIGS. 8 and 9 is substantially similar in construction to the first embodiment described with reference to FIGS. 1 through 4B except that the second rotary member 7 is directly carried by the rotary shaft 32 of the variable resistor 31 which is supported upon the printed circuit board 17 by its terminals 31*a*. That is, the rotary shaft 32 of the variable resistor 31 which is externally splined is fitted into the center hole 30 of the second rotary member 7 which is also internally splined. Therefore, upon rotation of the second rotary member 7, the rotary shaft 32 of the variable resistor 31 is also rotated. A pointer 33 is attached to the upper side surface of the second rotary member 7 so that the angle of rotation of the latter may be indicated through the window 21 of the top plate 20.

So far the present invention has been described in conjunction with the variable resistor, but it is to be understood that the fine adjustment mechanism of the present invention may be used in conjunction with variable capacitors or any type of impedance elements.

As described above, according to the present invention, a variable impedance element such as a variable resistor and the fine adjustment mechanism are disposed independently of each other, so that the characteristics of the variable impedance may be stabilized against the environmental conditions. Since the second rotary member is provided with the stopper in order to limit the angle of rotation, the damage to the variable impedance element may be prevented when the first rotary member is rotated in excess of a predetermined number of rotations. Moreover, the second rotary member is provided with indicating means or arcuate ridge or strip 19, so that the angle of rotation of the rotary shaft of the variable impedance element may be clearly indicated and the operation may be much facilitated. In the third embodiment, the second rotary member is splined to the rotary shaft of the variable impedance element, so that the shaft for the second rotary member may be eliminated. This means that the number of parts may be reduced, the machining and assembling steps may be considerably decreased, and the fine adjustment mechanism may be made compact in size and light in weight. According to the first embodiment of the present invention, one end of the shaft for the second rotary member terminates into the bifurcated retaining member which is snapped into the coaxial hole of the rotary shaft of the variable impedance element. Therefore, the fine adjustment mechanism of the present invention may be readily coupled to the conventional semi-fixed resistor that has a coaxial hole in the rotary adjusting shaft.

What is claimed is:

1. An assembly for fine adjustment of a variable impedance mechanism comprising a. a housing, a first disk-shaped rotary member mounted on a wall of said housing and having a raised spiral-shaped engaging means on one side surface thereof, b. a second disk-shaped rotary member having teeth formed along the periphery thereof for engagement with said raised spiral engaging means of said first disk-shaped rotary member, said second disk-shaped rotary member having a rotary shaft arranged to rotate about an axis which is contained in a plane perpendicular to the axis of rotation of said first disk-shaped rotary member, said raised spiral-shaped engaging means of said first disk-shaped rotary member being so formed that the angle of rotation of said second disk-shaped rotary member is smaller than the angle of rotation of said first disk-shaped rotary member, and c. a variable impedance element in said housing having a rotary shaft, and means for detachably coupling the rotary shaft of said second disk-shaped rotary member to the rotary shaft of the variable impedance element.

2. An assembly as set forth in claim 1 wherein said shaft of said second disk-shaped rotary member is provided with a stopper positioned to limit the angle of rotation of said second disk-shaped rotary member.

3. An assembly as set forth in claim 1 wherein means for indicating the angle of rotation of said rotary shaft of said variable impedance element is attached to one side surface of said second disk-shaped rotary member.

4. An assembly as set forth in claim 3 wherein said indicating means comprises an arcuate member which is formed on one side surface of said second disk-shaped rotary member coaxially thereof, the width of said arcuate member being linearly increased from one end to the other end.

5. An assembly as set forth in claim 1 wherein one end of said shaft of said second disk-shaped rotary member terminates into a flat bifurcated retaining member with its extreme ends tapered to converge outwardly, said bifurcated retaining member being retainably fitted into an elongated hole formed through said rotary shaft of said variable impedance element, so that said second disk-shaped rotary member is mechanically coupled to said variable impedance element.

6. An assembly as set forth in claim 5 wherein the other end of said shaft of said second disk-shaped rotary member terminates into a reduced diameter portion which is rotatably inserted into a hole formed through a first side wall of said housing with the stepped portion of said reduced diameter portion abutted against said side wall, and said extreme ends of said bifurcated retaining member are rotatably inserted into a hole formed through a second side wall of said housing disposed in opposed and spaced apart relation with said first side wall, whereby said shaft of said second disk-shaped rotary member may be securely and rotatably disposed between said first and second side walls.

7. An assembly as set forth in claim 5 wherein the other end of said shaft of said second disk-shaped rotary member terminates into a reduced diameter portion which is rotatably inserted into a hole formed through a first side wall of a casing with the stepped portion of said reduced diameter portion abutted against said first wall, and said extreme ends of said bifurcated retaining member at one end of said shaft is rotatably fitted into a coaxial hole formed at one end of the rotary shaft of another variable impedance element, whereby said shaft of said second disk-shaped rotary member and said rotary shaft of said another variable impedance element may be aligned with respect to each other.

8. An assembly for fine adjustment of a variable impedance element mechanism as set forth in claim 1 wherein said spiral engaging means is a spiral ridge.

9. An assembly as set forth in claim 1 wherein said spiral engaging means is a spiral groove.

10. An assembly as set forth in claim 4 wherein said arcuate member is an arcuate ridge on said second disk-shaped rotary member.

11. An assembly as set forth in claim 4 wherein said arcuate member is an arcuate strip mounted on said second disk-shaped rotary member.

* * * * *